US006889916B2

(12) United States Patent
Loyd et al.

(10) Patent No.: US 6,889,916 B2
(45) Date of Patent: May 10, 2005

(54) ROTATING SPA JET WITH PIN SUPPORTED NOZZLE

(75) Inventors: Casey Loyd, Pomona, CA (US); Pedro Vargas, Pomona, CA (US); Alberto Olivo, Pomona, CA (US)

(73) Assignee: California Acrylic Industries, Pomona, CA (US)

( * ) Notice: Subject to any disclaimer, the term of this patent is extended or adjusted under 35 U.S.C. 154(b) by 191 days.

(21) Appl. No.: 10/214,681

(22) Filed: Aug. 7, 2002

(65) Prior Publication Data

US 2004/0026542 A1 Feb. 12, 2004

(51) Int. Cl.[7] ..... B05B 3/06

(52) U.S. Cl. ..... 239/261; 239/587.1; 4/541.1; 4/541.6

(58) Field of Search ..... 239/587.1, 591, 239/DIG. 19; 4/492, 541.1, 541.2, 541.3, 541.4, 541.5, 541.6

(56) References Cited

U.S. PATENT DOCUMENTS

| | | | | | |
|---|---|---|---|---|---|
| 4,330,412 | A | * | 5/1982 | Frederick | 210/805 |
| 4,559,653 | A | | 12/1985 | Mathews | |
| 4,763,367 | A | | 8/1988 | Henkin et al. | |
| 4,853,987 | A | * | 8/1989 | Jaworski | 4/541.6 |
| 5,353,447 | A | | 10/1994 | Gravatt | |
| 5,366,021 | A | * | 11/1994 | Coleman | 169/16 |
| 5,657,496 | A | | 8/1997 | Corb et al. | |
| 5,810,257 | A | | 9/1998 | Ton | |
| 5,915,849 | A | | 6/1999 | Dongo | |
| 5,920,925 | A | | 7/1999 | Dongo | |
| 6,123,274 | A | | 9/2000 | Perdreau et al. | |
| 6,264,122 | B1 | | 7/2001 | Perdreau et al. | |
| 6,334,224 | B1 | * | 1/2002 | Chalberg et al. | 4/541.6 |
| 6,357,059 | B1 | * | 3/2002 | Lau | 4/541.1 |
| 6,470,509 | B1 | * | 10/2002 | Ayeni | 4/541.6 |
| 6,491,238 | B1 | * | 12/2002 | Swanson et al. | 239/587.4 |
| 6,510,277 | B1 | * | 1/2003 | Dongo | 385/147 |
| 2002/0029414 | A1 | * | 3/2002 | Shun Lau et al. | 4/541.1 |
| 2003/0089797 | A1 | * | 5/2003 | Buck | 239/261 |

FOREIGN PATENT DOCUMENTS

| | | | |
|---|---|---|---|
| GB | 2201890 A | * | 9/1988 |
| JP | 402227165 A | * | 9/1990 |

* cited by examiner

*Primary Examiner*—Harry B. Tanner
*Assistant Examiner*—Mohammad M Ali
(74) *Attorney, Agent, or Firm*—Denton L. Anderson; Sheldon & Mak

(57) ABSTRACT

A rotating spa jet has a body and a nozzle. The body has an upstream end, a downstream end and a flow path defined between the upstream end and the downstream end. The nozzle is disposed within the flow path proximate to the downstream end of the body. The nozzle is rotatable about a pin and is not supported in any way by ball bearings.

19 Claims, 3 Drawing Sheets

ROTATING SPA JET WITH PIN SUPPORTED NOZZLE

BACKGROUND OF THE INVENTION

Water recreational apparatuses, such as spas, hot tubs, swimming pools, recirculating bath tubs and the like, are becoming ever increasingly popular as recreational devices and as therapeutic devices.

The key feature of all such devices is a plurality of spa jets disposed in the side walls of the water basin of such equipment. Such spa jets provide the user with a pleasant and relaxing sensation. The spa jets also frequently provide the user with therapeutic benefits, as well.

One of the most popular spa jets is a rotating spa jet. In a typical rotating spa jet, water flowing through the jet rotates a rotatable discharge nozzle disposed at the outlet of the jet. The rotatable discharge nozzle rotates about a central axis with the aid of ball bearings.

A problem exists in the operation of such rotatable jets. This problem stems from the periodic entrainment of sand, grit and/or other sediment in the water stream flowing through the jet. Such sand, grit or other sediment can clog the ball bearings and will frequently lead to the premature failure of the jet.

Accordingly, there is a need for an improved spa jet which avoids this problem in the prior art.

SUMMARY OF THE INVENTION

The invention satisfies this need. The invention is a rotating spa jet comprising (a) a body having an open upstream end and an open downstream end and defining a flow path between the upstream end and the downstream end, and (b) a nozzle disposed within the flow path and within the body proximate to the downstream end of the body, the nozzle being rotatably affixed to a pin, the nozzle having a plurality of nozzle openings configured such that the flow of a liquid through the nozzle openings causes the nozzle to rotate about the pin, the nozzle not being supported by ball bearings.

DESCRIPTION OF THE DRAWINGS

These and other features, aspects and advantages of the present invention will become better understood with reference to the following description, appended claims and accompanying drawings where:

DETAILED DESCRIPTION

Figure 1:
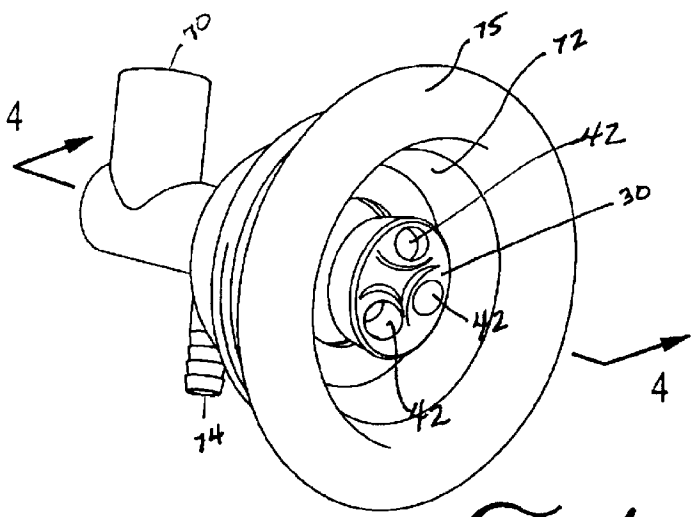
FIG. 1 is a perspective view of a first spa jet having features of the invention.
Figure 2:
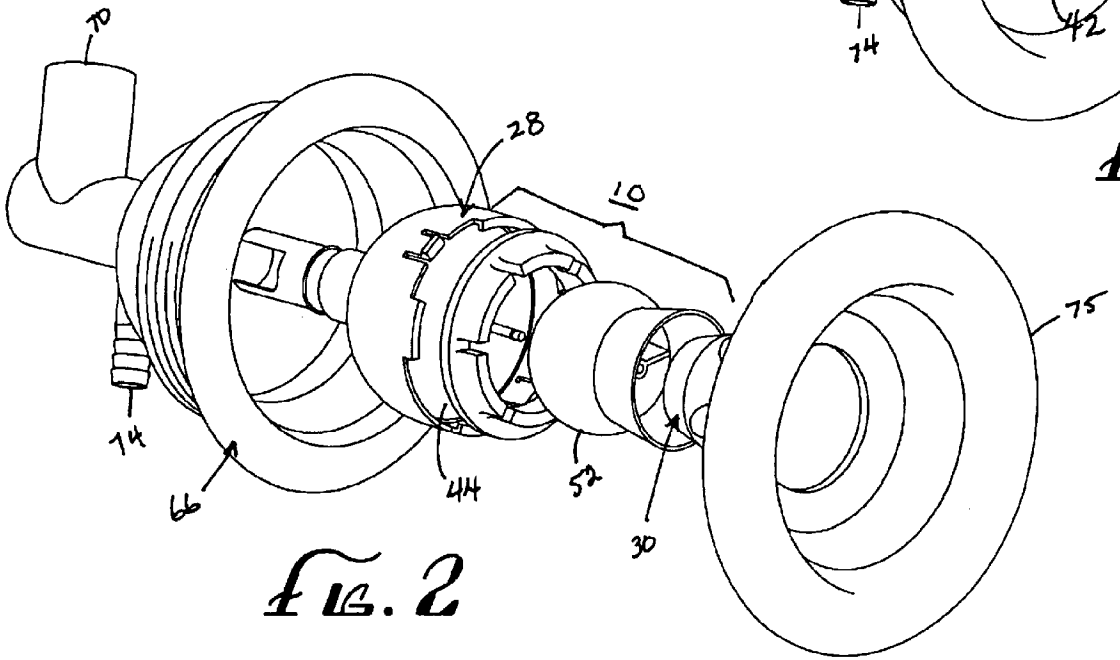
FIG. 2 is an exploded view of the spa jet illustrated in FIG. 1.
Figure 3:
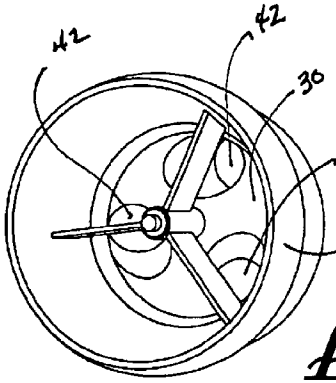
FIG. 3 is a rear side perspective view of a nozzle frame and nozzle useable in the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a rotating spa jet 10 useable in a water recreational apparatus 12, such as a spa, hot tub, swimming pool or recirculating bath tub. In a typical embodiment, the water recreational apparatus 12 comprises a water basin 14, a water pump 16, water circulation conduits 18 and a pump motor 20. The water basin 14 comprises side walls 22 and a bottom wall 24. Disposed within the bottom wall 24 is a drain opening 26. Disposed within the side walls 22 are one or more spa jets. In the invention, the side walls 22 of the water basin 14 comprise one or more rotating spa jets 10 of the present invention.

The rotating spa jet 10 of the present invention comprises a body 28 and a rotating nozzle 30. The body 28 has an open upstream end 32 and an open downstream end 34. Within the body 28 is defined a flow path 36 for the flow of water or other liquids between the upstream end 32 of the body 28 and the downstream end 34 of the body 28. The flow path 36 is typically linear and has a longitudinal axis 38.

The nozzle 30 is disposed within the flow path 36 and within the body 28 proximate to the downstream end 34 of the body 28. The nozzle 30 is rotatably affixed to a pin 40. The nozzle 30 is not supported in any way by ball bearings. In a typical embodiment, the pin 40 is disposed substantially parallel to the flow path 36.

The nozzle 30 has one or more nozzle openings 42 configured such that the flow of water or other liquid through the nozzle openings 42 causes the nozzle 30 to rotate about the axis of the pin 40. In the embodiments illustrated in the drawings, each of the spa jets 10 has a nozzle 30 with three nozzle openings 42, each disposed eccentrically with respect to the longitudinal axis 38 of the flow path 36.

In the embodiments illustrated in the drawings, each of the spa jets 10 further comprises an internal flow path tube 44 having an upstream end 46 and a downstream end 48. The internal flow path tube 44 is typically disposed within the flow path 36, along its longitudinal axis 38. The internal flow path tube 44 is disposed downstream of the upstream end 32 of the body 28 and upstream of the nozzle 30. The internal flow path tube 44 directs the flow of water or other liquid from the upstream end 42 of the body 28 to the upstream end of the nozzle 30.

In the embodiment illustrated in FIGS. 1–6, the downstream end 48 of the internal flow tube 44 comprises a cup 50. The cup 50 is partially shaped like a hollow sphere having an internal diameter. The nozzle 30 is disposed within a nozzle frame 52 having side walls with a partial circular external surface having an external diameter. The external diameter of the nozzle frame 52 is essentially identical to the internal diameter of the cup 50 so that the nozzle frame 52 is free to rotate in any direction within the cup 50. This feature allows the user of the spa jet 10 to adjust the flow from the nozzle 30 in any one of a myriad of nozzle positions.

Figure 4:
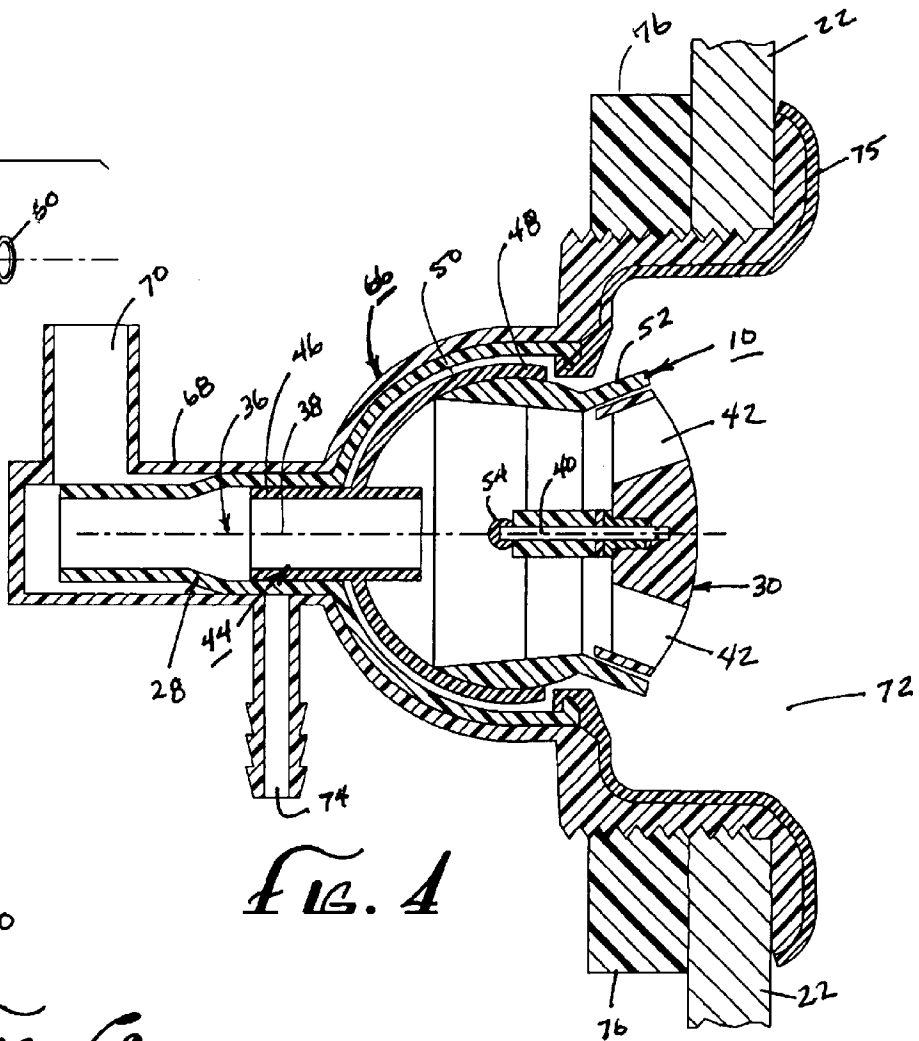
FIG. 4 is a cross-sectional side view of the spa jet illustrated in FIG. 1, taken along line 4—4.
Figure 5:
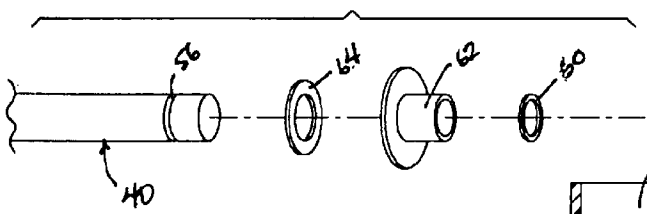
FIG. 5 is an exploded detail view of one end of a pin useable in the invention.
Figure 6:
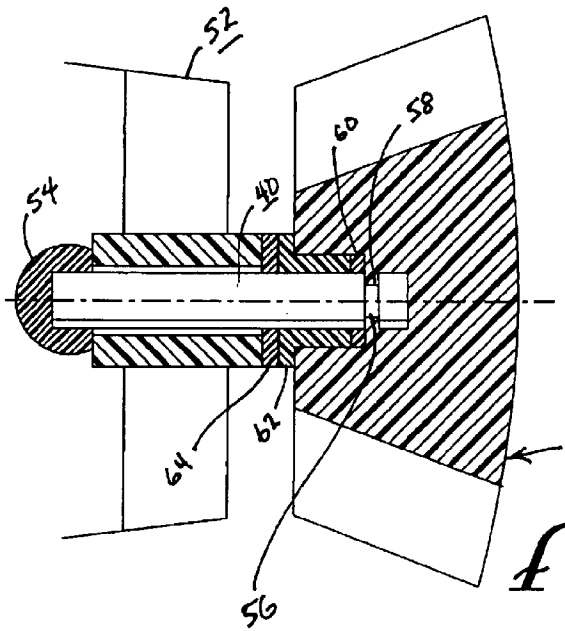
FIG. 6 is a cross-sectional detail view of a nozzle and flow path tube useable in the invention.

As illustrated in FIGS. 4–6, the pin 40 in the embodiment illustrated in FIGS. 4–6 is affixed to the nozzle frame 52. The pin 40 can be made from any suitable material, such as plastics or metals. In one embodiment, the pin 40 is made from titanium. In another embodiment, the pin 40 is a zinc clad stainless steel.

In the embodiment illustrated in FIG. 6, it can be seen that the upstream end of the pin 40 is affixed to the nozzle frame 52 by a pin cap 54. The pin cap 54 can be made of plastic. At the downstream end of the pin 40, the pin 40 has a circumferential groove 56. This allows for the downstream end of the pin 40 to snap into and be retained by a shoulder 58 molded into the interior of the nozzle 40. As illustrated in FIG. 5, the downstream end of the pin 40 can further comprise an O-ring 60, a bushing 62 and a washer 64.

The nozzle 30 is disposed within the nozzle frame 52 so that it can freely spin within the nozzle frame 52. As noted above, the spin of the nozzle 30 can be propagated by the flow of water or other liquid within the body 28 along the flow path 36.

The internal flow path tube 44 and the nozzle frame 52 are press-fit within one another so that they are easily removable from each other and from the valve body 28 without the necessity of screwdrivers, wrenches or other tools.

As illustrated in FIG. 4, the spa jet 10 can be disposed within a spa jet retainer frame 66. The retainer frame 66 comprises a retainer frame body 68, a water inlet opening 70, a water outlet opening 72, an air inlet opening 74, an attachment cover 75 and a threaded retainer nut 76. The retainer frame 66 illustrated in FIG. 4 is shown attached to the side walls 22 of the water basin 14 of a portable spa, hot tub, pool, recirculating bath tub or other water recreational apparatus 12.

Figures 7, 8, 9, 10:
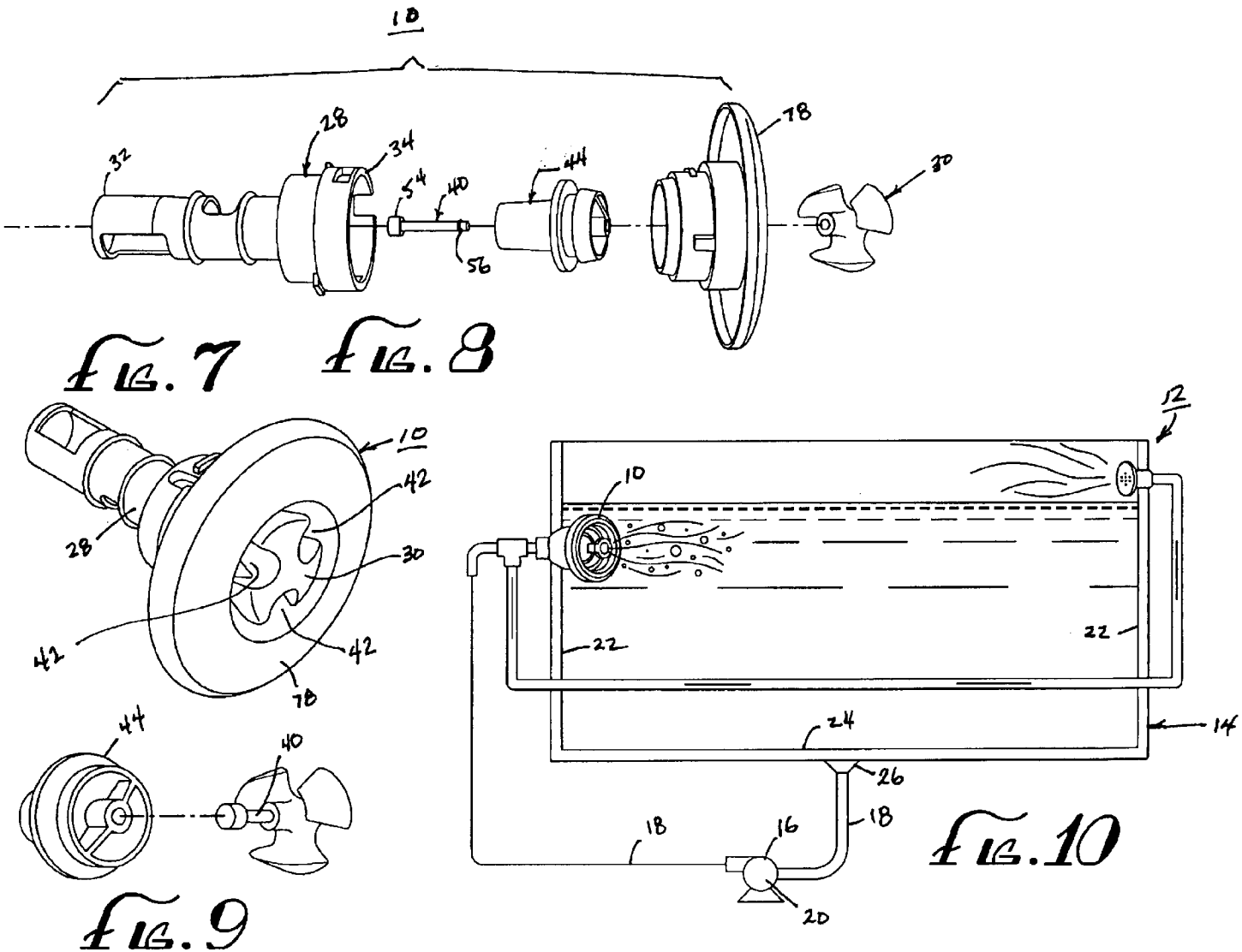
FIG. 7 is an isometric view of a second spa jet having features of the invention.
FIG. 8 is an exploded view of the spa jet illustrated in FIG. 7.
FIG. 9 is an exploded detail view of a nozzle and internal flow path tube useable in the spa jet illustrated in FIG. 7.
FIG. 10 is a water recreational apparatus having features of the invention.

FIGS. 7–9 illustrate a second embodiment of the invention 10. In this embodiment of the invention 10, the nozzle direction is fixed and is not adjustable (as was the embodiment illustrated in FIGS. 1–6). In the embodiment illustrated in FIGS. 7–9, the pin 40 is affixed to the internal flow path tube 44 and the nozzle 30 is affixed to the pin 40.

In the embodiment illustrated in FIGS. 7–9, the invention 10 further comprises an attachment cover 78.

Like the embodiment illustrated in FIGS. 1–6, the internal flow path tube 44 is press-fit into the valve body 28 and so is easily detachable from the valve body 28 without the necessity of tools.

Like the embodiment illustrated in FIGS. 1–6, the embodiment illustrated in FIGS. 7–9 has three eccentrically oriented nozzle openings 42 so that the flow of water or other liquid through the nozzle 30 necessarily causes the nozzle 30 to rotate.

The rotating spa jet 10 of the invention is useable with a water recreational apparatus 12 such as illustrated in FIG. 10. Because the rotating spa jet 10 of invention is not supported in any way by ball bearings, the rotating spa jet 10 of the invention is relatively impervious to damage and fouling from the circulation of entrained sand, grit or other sediment within the water circulation conduits 18.

The invention provides a simple, inexpensive and effective way of providing a rotating spa jet which does not rely upon ball bearings. Accordingly, the spa jet of the invention is less expensive to manufacture, less expensive to maintain and has a considerably longer life span.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A rotating spa jet comprising:

(a) a body having an open upstream end and an open downstream end and defining a flow path between the upstream end and the downstream end;

(b) a pin disposed within the flow path and within the body proximate to the downstream end of the body having a circumferential groove at the downstream end of the pin; and (c) a nozzle disposed within the flow path and within the body proximate to the downstream end of the body, the nozzle having a shoulder adapted to engage the circumferential groove of the pin and thereby rotatably affix the nozzel to the pin, the nozzle having one or more nozzle openings configured such that the flow of a liquid through the nozzle openings causes the nozzle to rotate about the pin, the nozzle not being supported by ball bearings.

2. The spa jet of claim 1 wherein the pin is disposed substantially parallel to the flow path.

3. The spa jet of claim 1 further comprising an internal flow path tube disposed within the flow path and upstream of the nozzle, the internal flow path tube having an upstream end and a downstream end.

4. The spa jet of claim 3 wherein the pin is affixed to the internal flow path tube.

5. The spa jet of claim 4 wherein the downstream end of the internal flow path tube comprises a cup and wherein the nozzle is disposed within the cup.

6. The spa jet of claim 5 wherein the nozzle is attached to a nozzle frame disposed within the cup.

7. The spa jet of claim 6 wherein the pin is affixed to the nozzle frame.

8. The spa jet of claim 6 wherein the nozzle frame is removable from the cup without the use of tools.

9. The spa jet of claim 3 wherein the internal flow path tube is removable from the body without tools.

10. The spa jet of claim 1 wherein the pin is a zinc clad stainless steel.

11. A rotating spa jet comprising:

(a) a body having an open upstream end and an open downstream end and defining a flow path between the upstream end and the downstream end;

(b) an internal flow path tube disposed within the flow path, the internal flow path tube having an upstream end and a downstream end;

(c) a pin affixed to the internal flow path tube, wherein the pin has a circumferential groove at the downstream end of the pin; and (d) a nozzle disposed within the flow path and within the body at the downstream end of the internal flow path tube and proximate to the downstream end of the body, the nozzle having a shoulder adapted to engage the circumferential groove of the pin and thereby rotatably affix the nozzle to the pin, the nozzle having one or more nozzle openings configured such that the flow of a liquid through the nozzle openings causes the nozzle to rotate about the pin.

12. The spa jet of claim 11 wherein the pin is disposed substantially parallel to the flow path.

13. The spa jet of claim 11 wherein the downstream end of the internal flow path tube comprises a cup and wherein the nozzle is disposed within the cup.

14. The spa jet of claim 14 wherein the nozzle is attached to a nozzle frame disposed within the cup.

15. The spa jet of claim 14 wherein the pin is affixed to the nozzle frame.

16. The spa jet of claim 14 wherein the nozzle frame is removable from the cup without the use of tools.

17. The spa jet of claim 11 wherein the internal flow path tube is removable from the body without tools.

18. The spa jet of claim 11 wherein the pin is a zinc clad stainless steel pin.

19. A water recreational apparatus comprising:

(a) a water basin capable of retaining a human being partially submerged below a level of water, the water basin having at least one drain opening and having a plurality of water inlet openings;

(b) a water pump;

(c) water circulation conduits connecting the at least one water basin drain opening to the pump and connecting the pump to the plurality of water input openings in the water basin;

(d) a motor for driving the pump; and (e) at least one rotating spa jet disposed within the plurality of water input openings, the at least one rotating spa jet comprising:

(i) a body having an open upstream end and an open downstream end and defining a flow path between the upstream end and the downstream end; and (ii) a pin disposed within the flow path and within the body proximate to the downstream end of the body having a circumferential groove at the downstream end of the pin;

(iii) a nozzle disposed within the flow path and within the body proximate to the downstream end of the body, the nozzle having a shoulder adapted to engage the circumferential groove of the pin and thereby rotatably affix the nozzle to the pin, the nozzle having one or more nozzle openings configured such that the flow of a liquid through the nozzle openings causes the nozzle to rotate about the pin, the nozzle not being supported by ball bearings.

* * * * *